US012648609B2

(12) United States Patent
Lee et al.

(10) Patent No.: US 12,648,609 B2
(45) Date of Patent: Jun. 9, 2026

(54) GUIDE MEANS FOR HELMET

(71) Applicant: HJC CORP., Gyeonggi-do (KR)

(72) Inventors: Jin Hwan Lee, Gyeonggi-do (KR); Ki Young Nam, Seoul (KR)

(73) Assignee: HJC CORP., Gyeonggi-do (KR)

( * ) Notice: Subject to any disclaimer, the term of this patent is extended or adjusted under 35 U.S.C. 154(b) by 18 days.

(21) Appl. No.: 18/712,179

(22) PCT Filed: Sep. 19, 2022

(86) PCT No.: PCT/KR2022/013954
§ 371 (c)(1),
(2) Date: May 21, 2024

(87) PCT Pub. No.: WO2023/096117
PCT Pub. Date: Jun. 1, 2023

(65) Prior Publication Data

US 2025/0017307 A1 Jan. 16, 2025

(30) Foreign Application Priority Data

Nov. 25, 2021 (KR) ..... 10-2021-0164548

(51) Int. Cl.
*A42B 3/22* (2006.01)
*A42B 3/30* (2006.01)

(52) U.S. Cl.
CPC ..... *A42B 3/221* (2013.01); *A42B 3/30* (2013.01)

(58) Field of Classification Search
CPC ..... A42B 3/22; A42B 3/221; A42B 3/222; A42B 3/223; A42B 3/224; A42B 3/225; A42B 3/226; A42B 3/227; A42B 3/228; A42B 3/30; A42B 3/303; A42B 3/306; A42B 3/04
See application file for complete search history.

(56) References Cited

U.S. PATENT DOCUMENTS 4,473,130 A * 9/1984 Korber ..... A42B 3/30 181/22
4,584,721 A * 4/1986 Yamamoto ..... A42B 3/245 219/203
4,729,132 A * 3/1988 Fierro ..... A42B 3/285 2/171.4
5,590,209 A * 12/1996 Pratt ..... H04R 1/083 455/100
6,075,857 A * 6/2000 Doss, Jr. ..... A42B 3/30 379/430

(Continued)

FOREIGN PATENT DOCUMENTS

CN 210329496 4/2020
FR 2827744 A1 * 1/2003 ..... A42B 3/30

(Continued)

*Primary Examiner* — F Griffin Hall
(74) *Attorney, Agent, or Firm* — DUANE MORRIS LLP; Gregory M. Lefkowitz; Daniel J. Tarr

(57) ABSTRACT

The present disclosure relates to a guide means for a helmet, and the guide means for a helmet according to the present disclosure includes a guide member (100) configured to secure a space between a shell (10) and a wire (40) in order to guide a preset member (60) to be inserted into the space between the shell (10) and the wire (40), the wire (40) being connected to a control member (50) for controlling a movement member of a helmet.

10 Claims, 9 Drawing Sheets

(56) References Cited

U.S. PATENT DOCUMENTS

| | | | | |
|---|---|---|---|---|
| 6,608,908 | B1 * | 8/2003 | Galet | H04R 1/1058 379/430 |
| 6,978,034 | B2 * | 12/2005 | Lazzeroni | A42B 3/30 381/384 |
| 7,024,704 | B2 * | 4/2006 | Gafforio | A42B 3/326 2/424 |
| 8,600,094 | B2 * | 12/2013 | Kushnirov | H04R 1/028 381/384 |
| 8,688,040 | B2 * | 4/2014 | Jung | A42B 3/30 455/575.2 |
| 8,973,173 | B2 * | 3/2015 | Elam | A42B 3/30 2/424 |
| 9,032,548 | B2 * | 5/2015 | Isobe | A42B 3/226 2/10 |
| 9,167,861 | B2 * | 10/2015 | Gafforio | A42B 3/226 |
| 10,488,669 | B2 * | 11/2019 | Kuriki | H04N 23/50 |
| 11,382,380 | B2 * | 7/2022 | Dutour | G08B 5/36 |

FOREIGN PATENT DOCUMENTS

| | | |
|---|---|---|
| JP | 2015-092039 | 5/2015 |
| KR | 2019980020325 | 7/1998 |
| KR | 10-1076050 | 10/2011 |
| KR | 20-0461561 | 7/2012 |
| KR | 10-2159647 | 9/2020 |

* cited by examiner

GUIDE MEANS FOR HELMET

TECHNICAL FIELD

The present disclosure relates to a guide means for a helmet.

BACKGROUND ART

In general, wearing a helmet is required to protect a user's head when riding a motorcycle with high speed. Such a helmet has an opening at the front to secure a forward vision of a user. In this case, a shield that may be selectively opened or closed may be provided in the opening to block wind and dust introduced during operation. Also, a visor that may vertically move may be provided in the opening to block sunlight or the like from directly entering the user's eyes during the day.

The visor is vertically pivoted by manipulating an operation unit provided on one side of the helmet, and the visor and the operation unit are connected to each other through a visor control wire. However, as disclosed in the related literature below, when a Bluetooth headset is fixed to the helmet by using a clamp unit, the clamp unit may press or push the visor control wire. As such, when the clamp unit presses or pushes the visor control wire, not only may the visor control wire not operate easily, but permanent deformation may occur as the visor control wire is bent. Accordingly, there is a need for technology to prevent the visor control wire from being pressed or pushed by the clamp unit.

RELATED LITERATURE

Patent Literature (Patent Literature 1) KR 10-1076050 B1

DISCLOSURE

Technical Problem

To solve the problems of the related art, an aspect of the present disclosure relates to a guide means for a helmet which may prevent a wire from being pressed or pushed by a preset member by employing a guide member for guiding the preset member (clamp for fixing wireless communication equipment) into a space between a shell and the wire, the wire being connected to a control member for controlling a movement member (visor).

Technical Solution

A guide means for a helmet according to an embodiment of the present disclosure includes a guide member configured to secure a space between a shell and a wire in order to guide a preset member to be inserted into the space between the shell and the wire, the wire being connected to a control member for controlling a movement member of a helmet.

Also, in the guide means for a helmet according to an embodiment of the present disclosure, the guide member may be coupled to the wire and extend from the wire, or may be coupled to the shell and extend from the shell.

Also, in the guide means for a helmet according to an embodiment of the present disclosure, the guide member may be coupled to the wire to surround the wire.

Also, in the guide means for a helmet according to an embodiment of the present disclosure, the guide member may be formed in a sheet shape and may be coupled to the wire.

Also, in the guide means for a helmet according to an embodiment of the present disclosure, an adhesive component may be formed on one surface of the guide member.

Also, in the guide means for a helmet according to an embodiment of the present disclosure, the guide member may be folded along a certain line so that the one surface of the guide member is divided into a first area and a second area based on the certain line, and the first area and the second area are adhered to each other by the adhesive component.

Also, in the guide means for a helmet according to an embodiment of the present disclosure, a display unit for guiding insertion of the preset member may be displayed at one end of the guide member.

Also, in the guide means for a helmet according to an embodiment of the present disclosure, the movement member may be a visor, and the control member may be configured to control pivoting of the visor.

Also, in the guide means for a helmet according to an embodiment of the present disclosure, the guide means for a helmet may further include a pad unit provided inside the shell, wherein the guide member is located between the pad unit and the shell.

Also, in the guide means for a helmet according to an embodiment of the present disclosure, the pad unit may include a first pad portion located inside the shell, and a second pad portion located inside the first pad portion and including an insertion portion formed on one side, the insertion portion being inserted between the shell and the first pad portion, wherein, when one end of the wire coupled to the control member is located between the shell and the insertion portion, a slit portion or a through-portion through which the wire passes is formed in the insertion portion, and the wire passes through the slit portion or the through-portion, and then is located between the insertion portion and the first pad portion.

Also, in the guide means for a helmet according to an embodiment of the present disclosure, the guide member may be coupled to the wire passing through the slit portion or the through-portion and may be covered by the insertion portion.

Also, in the guide means for a helmet according to an embodiment of the present disclosure, the preset member may be a clamp for fixing wireless communication equipment to the helmet.

The features and advantages of the present disclosure will become more apparent from the following detailed description based on the attached drawings.

Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

Advantageous Effects

According to the present disclosure, the wire may be prevented from being pressed or pushed by the preset member, by employing a guide member for guiding a preset member (clamp for fixing wireless communication equipment) into a space between a shell and a wire connected to a control member for controlling a movement member (visor).

BEST MODE

Figure 1:
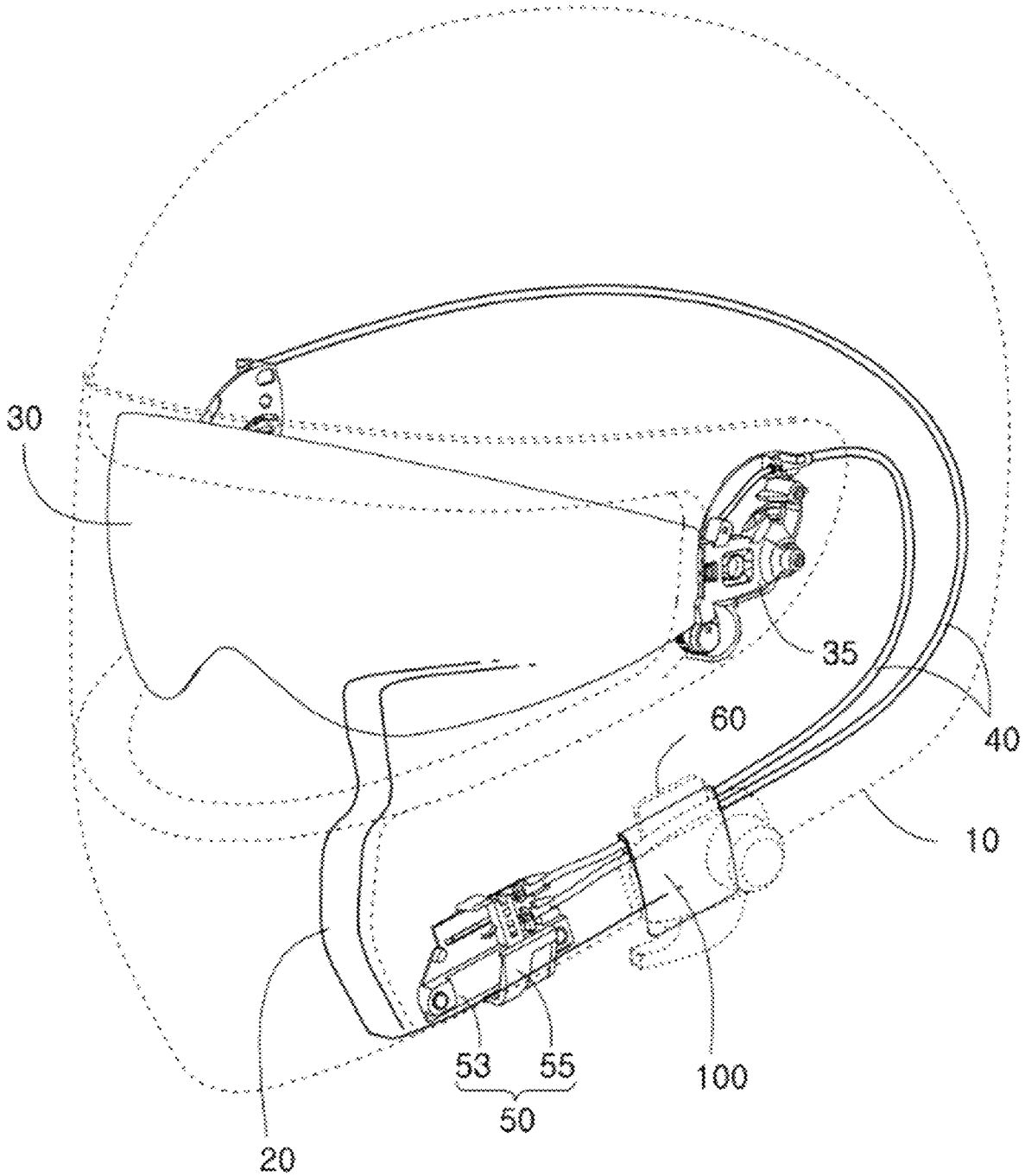
FIGS. 1 and 2 are perspective views illustrating a helmet provided with a guide means for a helmet according to an embodiment of the present disclosure.

The objects, advantages, and features of the present disclosure will become more obvious from the following detailed description and preferred embodiments provided in relation to the accompanying drawings. In adding reference numerals to elements of each drawing, it should be noted that the same elements are denoted by the same reference numerals as much as possible even when they are shown on different drawings. Also, although the terms "first," "second," etc. may be used herein to describe various elements, these elements should not be limited by these terms. These terms are only used to distinguish one element from another. In the description of the present disclosure, detailed explanations of the related art are omitted when it is deemed that they may unnecessarily obscure the essence of the present disclosure.

Hereinafter, preferred embodiments of the present disclosure will be described in detail with reference to the accompanying drawings.

Figure 2:
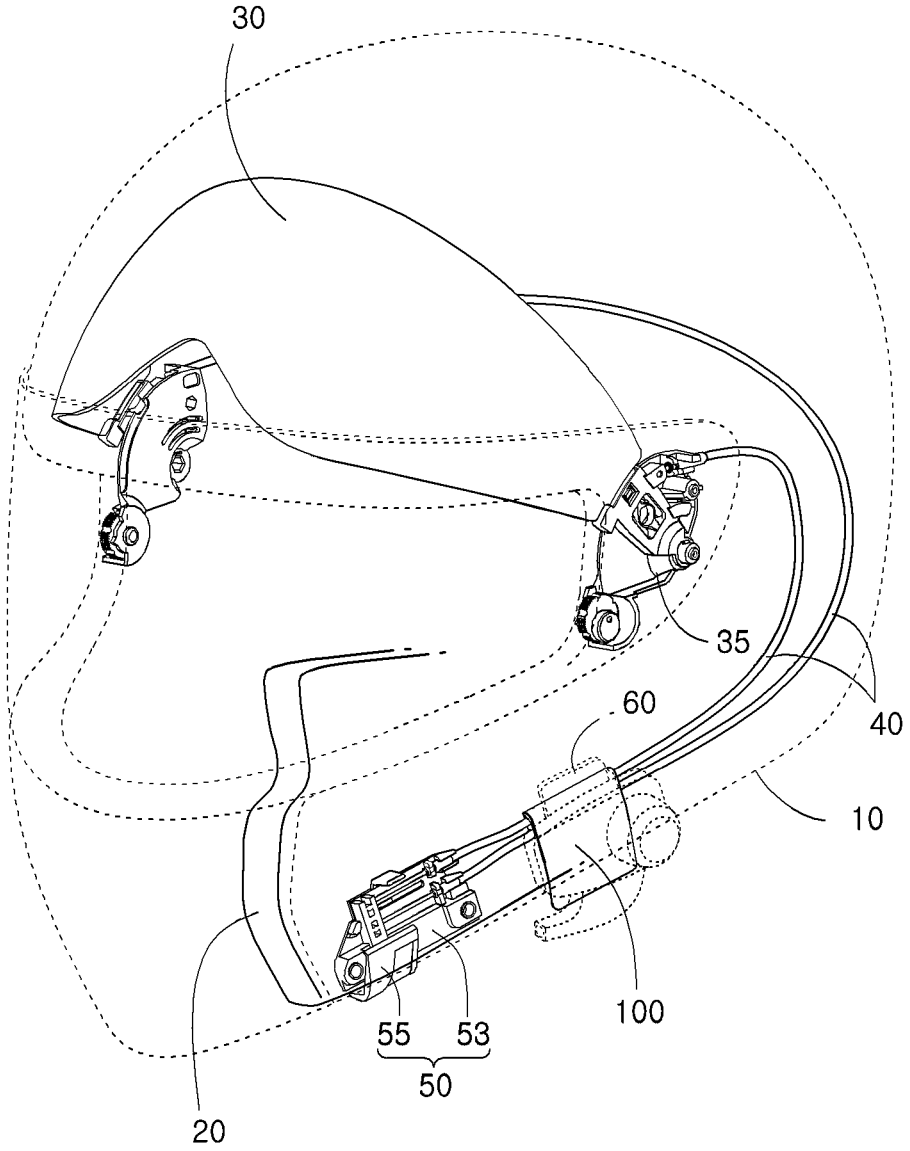
Figure 3:
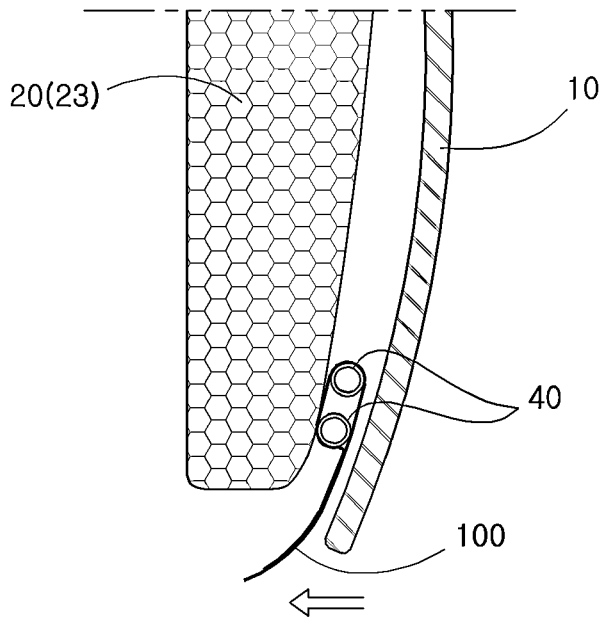
FIGS. 3 and 4 are partial cross-sectional views illustrating a helmet provided with a guide means for a helmet according to an embodiment of the present disclosure.
Figure 4:
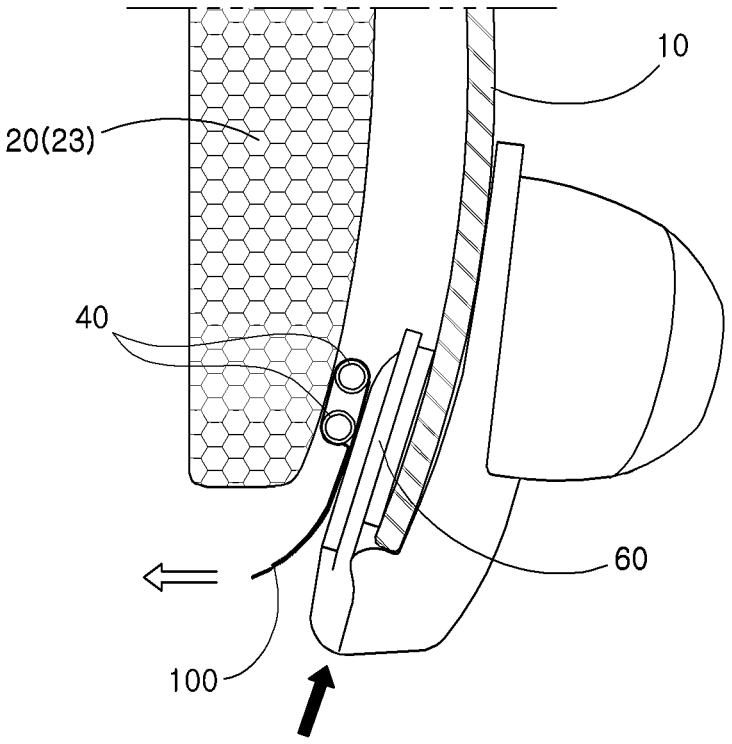

FIGS. 1 and 2 are perspective views illustrating a helmet provided with a guide means for a helmet according to an embodiment of the present disclosure. FIGS. 3 and 4 are partial cross-sectional views illustrating a helmet provided with a guide means for a helmet according to an embodiment of the present disclosure.

As shown in FIGS. 1 to 4, a guide means for a helmet according to the present disclosure includes a guide member 100 configured to secure a space between a shell 10 and a wire 40 in order to guide a preset member, such as a clamp 60, to be inserted into the space between the shell 10 and the wire 40, the wire 40 being connected to a control member 50 for controlling a movement member of a helmet.

The guide means for a helmet according to the present embodiment may be applied to a helmet. The helmet includes the shell 10, a visor 30, the wire 40, and the control member 50. The shell 10 for protecting a user's head may be formed of a material that may absorb impact. For example, the shell 10 may be formed of a hard synthetic resin having high strength. Also, the visor 30 for blocking sunlight or the like from directly entering the user's eyes may extend in an arc shape to be located in front of the user's eyes. In this case, the visor 30 may be rotatably coupled to both sides of the shell 10 through a visor controller 35 and may rotate with respect to the shell 10 and move between a first position (see FIG. 1) and a second position (see FIG. 2). For example, the first position refers to a position at which the visor 30 is located in front of the user's eyes (see FIG. 1), and the second position refers to a position at which the visor 30 is accommodated in an upper receiving space of the shell 10 (see FIG. 2). In this case, the visor 30 may be controlled by the control member 50. In detail, one end of the wire 40 may be coupled to the control member 50, and the other end of the wire 40 may be coupled to the visor controller 35 rotatably coupled to the shell 10. Accordingly, when the control member 50 is manipulated to move (pull or push) the wire 40, the visor controller 35 may pivot, and thus, the visor 30 may pivot to the first position or the second position. More specifically, the control member 50 may be provided on a lower region of a side surface of the shell 10. The control member 50 may include a base member 53 fixed to the shell 10 and an operation member 55 slidably coupled to the base member 53. In this case, one end of the wire 40 is connected to the operation member 55. Accordingly, when the user manipulates and slides the operation member 55, the wire 40 may be pulled or pushed to control the visor 30.

The wire 40 may extend along a lower inner side of the side surface of the shell 10. When a clamp 60 for fixing wireless communication equipment (e.g., a Bluetooth headset) is coupled to the shell 10, the clamp 60 may press or push the wire 40. In this case, not only may the wire 40 not operate easily, but permanent deformation may occur as the wire 40 is bent. However, the guide means for a helmet according to the present embodiment may prevent the clamp 60 from pressing or pushing the wire by employing the guide member 100.

Figure 5:
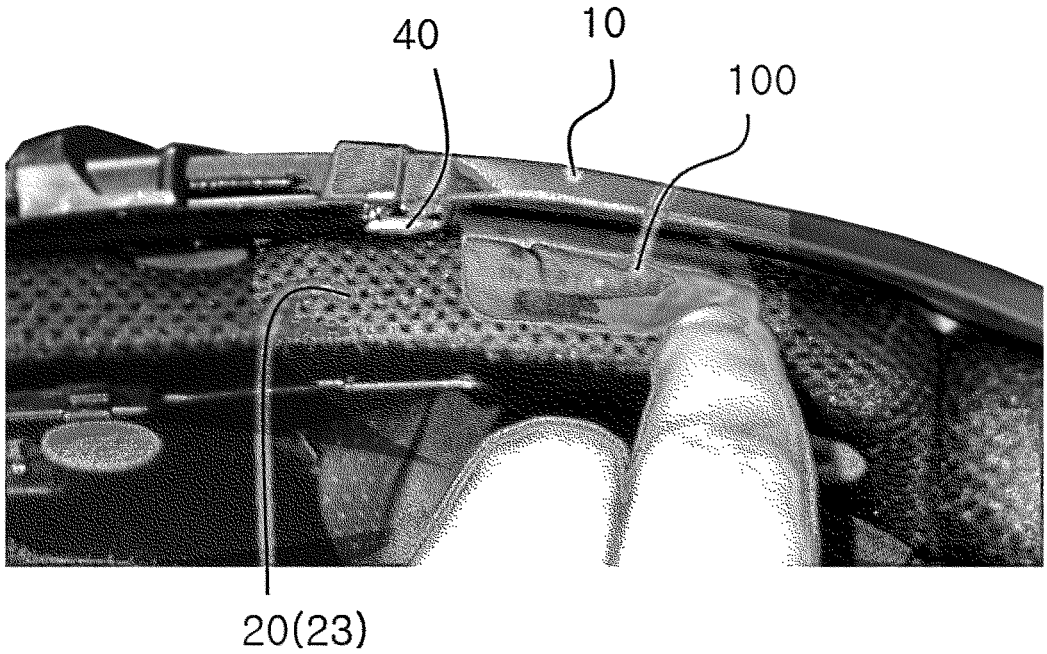
FIG. 5 is a photograph illustrating a guide means for a helmet according to an embodiment of the present disclosure.

As shown in FIGS. 3 and 4, the guide member 100 secures a space between the wire 40 and the shell 10 in order to guide the clamp 60 to be inserted into the space between the wire 40 and the shell 10. The guide member 100 may be coupled to the wire 40 and may extend from the wire 40. In this case, because the guide member 100 is located between the shell 10 and a pad unit 20 (e.g., a first pad portion 23) and extends from the wire 40 to be exposed to the outside of the pad unit 20 (e.g., the first pad portion 23), the user may insert the clamp 60 into the space between the wire 40 and the shell 10 by using the exposed guide member 100. As such, when the clamp 60 is guided by the guide member 100 to be inserted into the space between the wire 40 and the shell 10, the clamp 60 may be completely prevented from pressing or pushing the wire 40. For example, as shown in FIG. 5, the guide member 100 exposed to the outside of the pad unit 20 (e.g., the first pad portion 23) may be pulled with a finger, and then the clamp 60 may be inserted into the space between the wire 40 and the shell 10.

Figure 6:
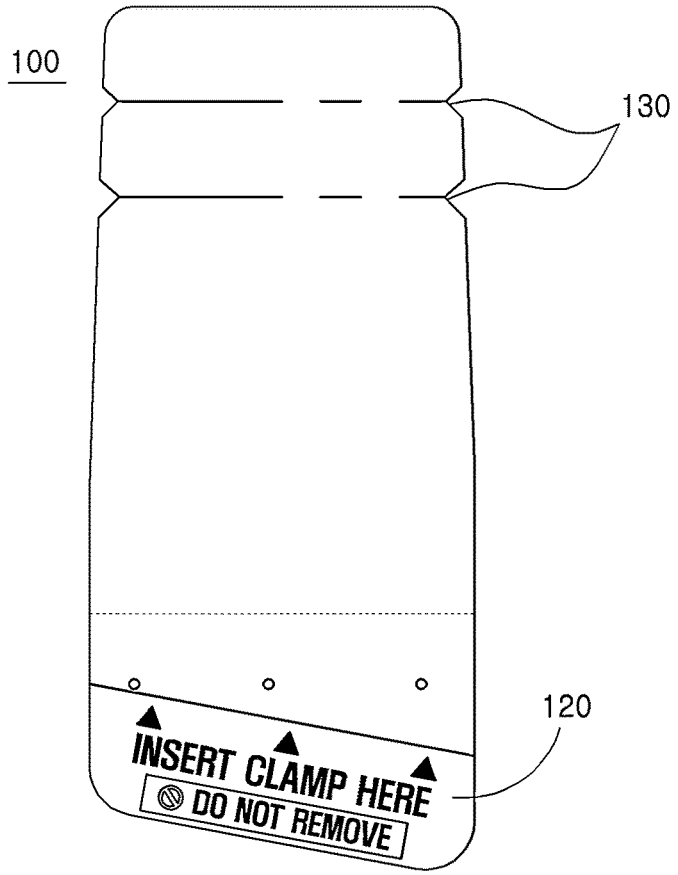
FIG. 6 is a plan view illustrating a guide means for a helmet according to an embodiment of the present disclosure.
Figure 7:
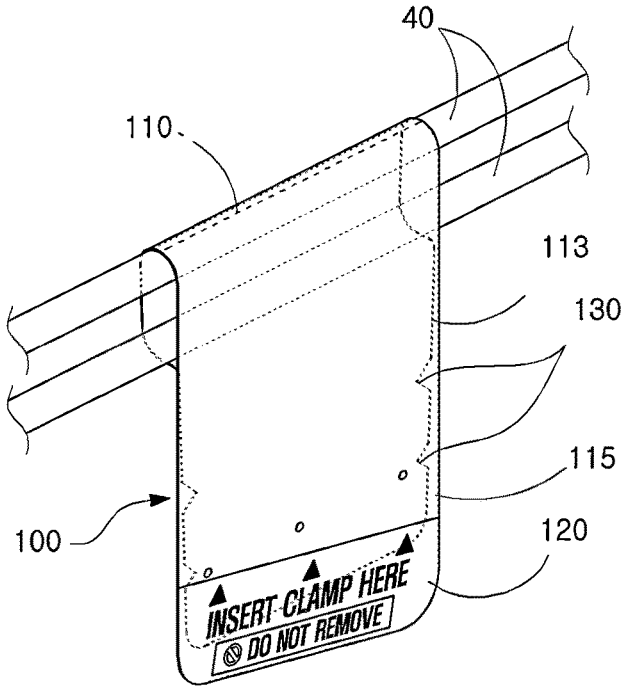
FIG. 7 is a perspective view illustrating a guide means for a helmet according to an embodiment of the present disclosure.

In detail, as shown in FIGS. 6 and 7, the guide member 100 may be formed in a sheet shape and may be coupled to the wire 40 to surround the wire 40. An adhesive component may be formed on one surface of the guide member 100 formed in a sheet shape, and the guide member 100 may be coupled to the wire 40 by the adhesive component. In detail, the guide member 100 may be folded along a virtual certain line 110 so that the one surface of the guide member 100 is divided into a first area 113 and a second area 115 based on the certain line 110. In this case, the first area 113 and the second area 115 may be adhered to each other by the adhesive component. As a result, when the guide member 100 is folded and the first and second areas 113, 115 are adhered to each other by the adhesive component, the guide member 100 may be coupled to the wire 40.

Although the guide member 100 is formed in a sheet shape, the present disclosure is not necessarily limited thereto, and the guide member 100 may be any known means coupled to the wire 40 to surround the wire 40, such as a cable tie.

A display unit 120 for guiding insertion of the clamp 60 may be displayed at one end of the guide member 100. Because the one end of the guide member 100 is exposed to the outside of the pad unit 20 (e.g., the first pad portion 23) (see FIG. 5), the display unit 120 displayed at the one end of the guide member 100 may also be exposed to the outside of the pad unit 20 (e.g., the first pad portion 23) and the user may insert the clamp 60 according to the instruction of the display unit 120. Although not particularly limited, but for example, text saying "INSERT CLAMP HERE" and an arrow indicating the insertion direction of the clamp 60 may be displayed on the display unit 120.

In addition, at least one perforated line 130 may be displayed on the guide member 100 (see FIG. 6). A relative position of the wire 40 may vary according to a model. According to a model, the guide member 100 may be used as it is or the guide member 100 may be cut along the perforated line 130 to appropriately adjust the overall length of the guide member 100. For example, when a relatively long guide member is required, the guide member 100 may be used as it is, and when a relatively short guide member is required, the guide member 100 may be cut along the perforated line 130 and used. Accordingly, the guide member 100 having a certain length may be manufactured and may be applied to various models.

MODE FOR INVENTION

Figure 8:
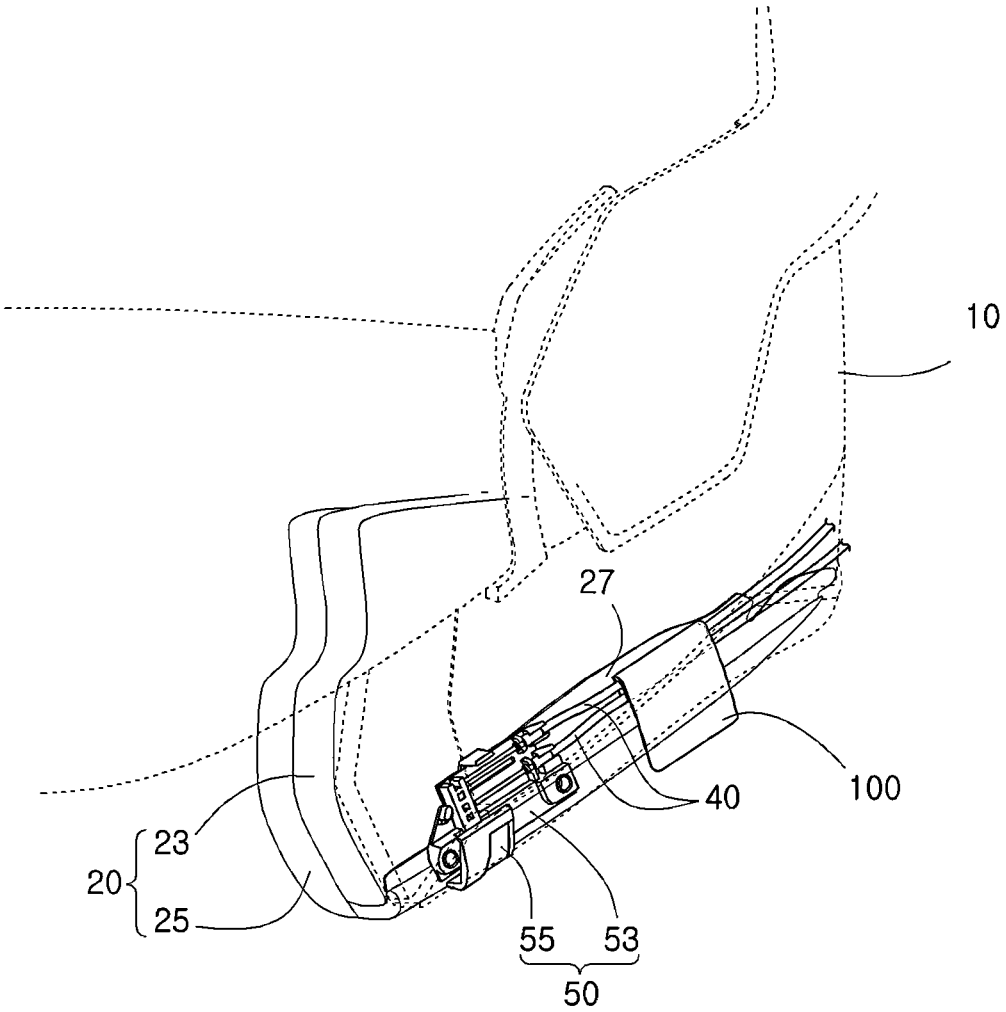
FIGS. 8 to 10 are detailed perspective views illustrating a helmet provided with a guide means for a helmet according to an embodiment of the present disclosure.
Figure 9:
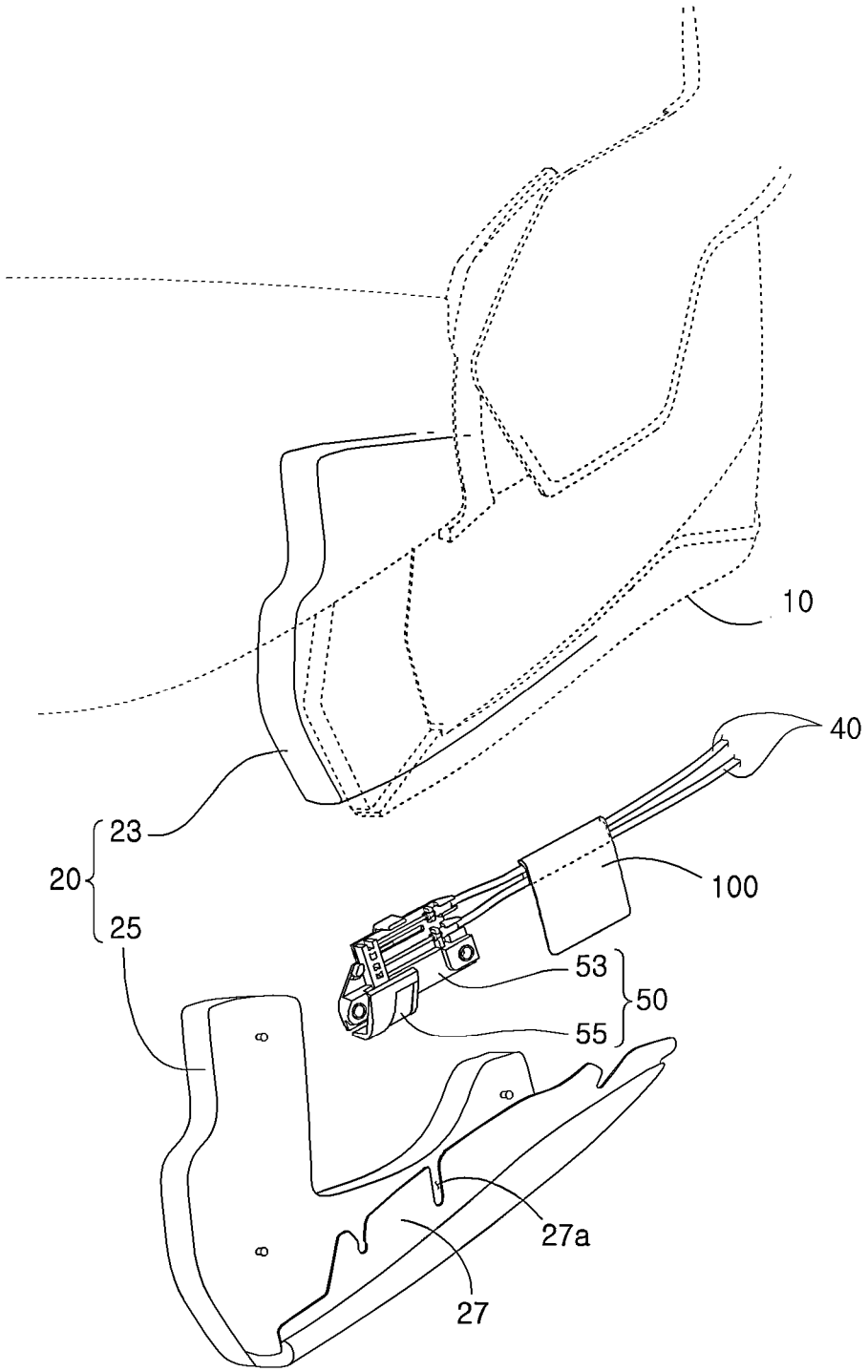
Figure 10:
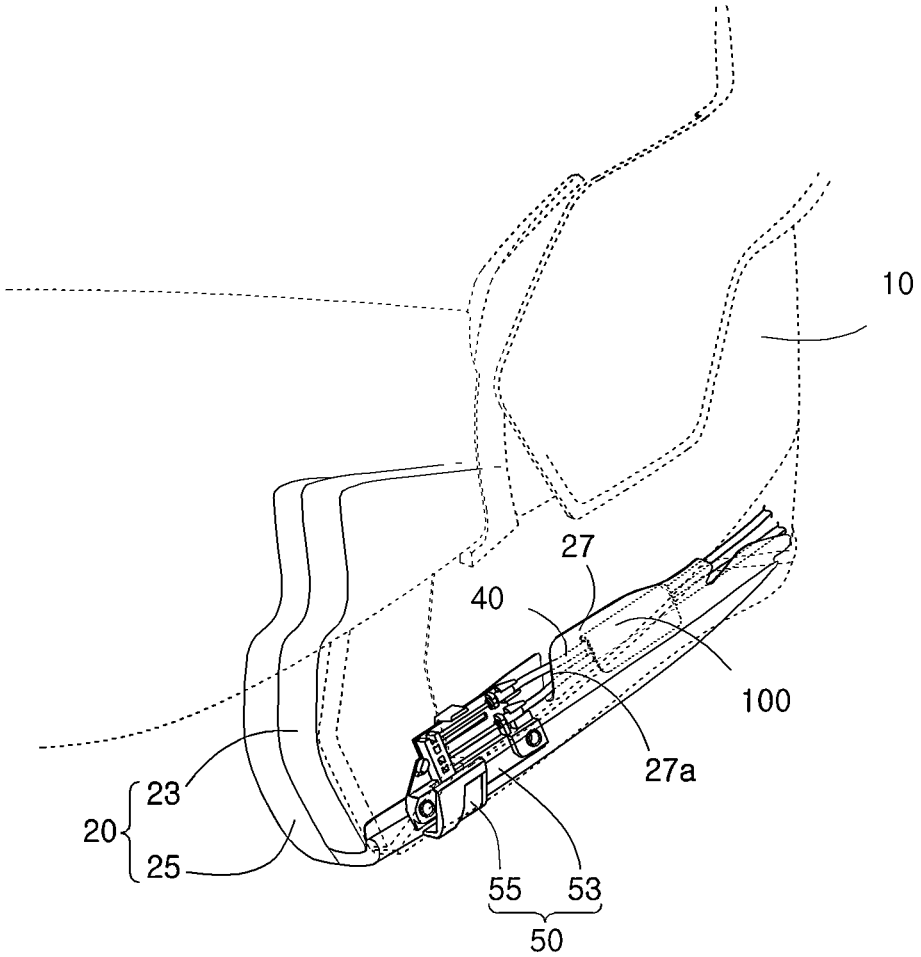

As shown in FIGS. 8 to 10, the pad unit 20 may be provided inside the shell 10. The pad unit 20 may include the first pad portion 23 and a second pad portion 25. In this case, the first pad portion 23 is located inside the shell 10 and is formed of expanded polystyrene (EPS) or the like to have appropriate strength and elasticity. Also, the second pad portion 25 is located inside the first pad portion 23 and directly contacts the user to improve wearing stability.

More specifically, an insertion portion 27 inserted between the shell 10 and the first pad portion 23 may be formed on one side of the second pad portion 25. That is, the shell 10, the first pad portion 23, and the second pad portion 25 may be arranged in this order, and the insertion portion 27 of the second pad portion 25 may be inserted into a space between the shell 10 and the first pad portion 23. As shown in FIG. 8, the wire 40 coupled to the operation member 55 of the control member 50 may be located between the shell 10 and the insertion portion 27. Accordingly, the guide member 100 coupled to the wire 40 may be exposed to the outside not only when the clamp 60 is inserted but also during normal times. To prevent this, as shown in FIGS. 9 and 10, a slit portion 27*a* through which the wire 40 passes may be formed in the insertion portion 27 of the second pad portion 25. The wire 40 may pass through the slit portion 27*a* and then may be located between the insertion portion 27 of the second pad portion 25 and the first pad portion 23. In this case, the guide member 100 is coupled to the wire 40 that passes through the slit portion 27*a* and then is located between the insertion portion 27 and the first pad portion 23 (see FIG. 10). Accordingly, the guide member 100 is covered by the insertion portion 27 of the second pad portion 25 during normal times, and thus, may not be exposed to the outside. When it is necessary to insert the clamp 60, the second pad portion 25 may be removed and then the guide member 100 extending from the wire 40 may be exposed to the outside of the first pad portion 23 (see FIG. 5) so that the user inserts the clamp 60 into a space between the wire 40 and the shell 10 by using the exposed guide member 100.

The slit portion 27*a* is not necessarily formed in the insertion portion 27 of the second pad portion 25, and a through-portion may be formed.

Although the control member 50 and the wire 40 control pivoting of the visor 30 in the specification, the present disclosure is not necessarily limited thereto, and the control member 50 and the wire 40 may control any type of movement member applied to the helmet. Also, although the guide member 100 guides insertion of the clamp 60, the present disclosure is not necessarily limited thereto, and the guide member 100 may guide insertion of any type of preset member coupled to the helmet.

Figure 11:
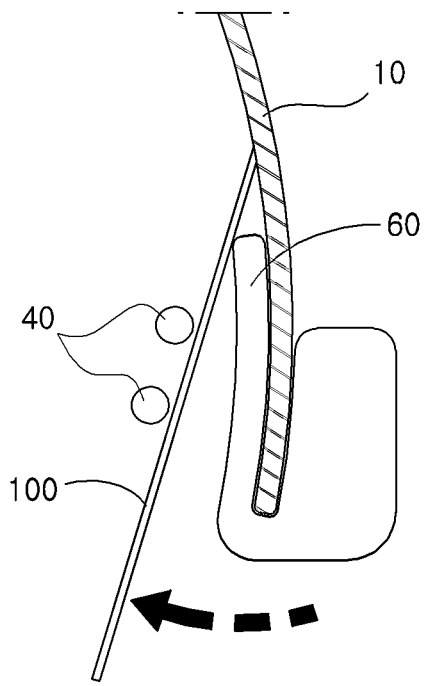
FIG. 11 is a partial cross-sectional view illustrating a helmet provided with a guide means for a helmet according to another embodiment of the present disclosure.

Although the guide member 100 is coupled to the wire 40 and extends from the wire 400, the guide member 100 does not necessarily have to be coupled to the wire 400. For example, as shown in FIG. 11, the guide member 100 may be coupled to the inside of the shell 10 and may extend to separate the wire 400 from an inner wall of the shell 10, secure a space between the wire 40 and the shell 10, and allow the clamp 60 to be inserted into the space.

While the present disclosure has been described in detail with reference to the specific exemplary embodiments for specifically explaining the present disclosure, the present disclosure is not limited to the exemplary embodiments, and it is apparent that the alteration or modification may be made by one of ordinary skill in the art without departing from the technical spirit of the present disclosure.

The simple alteration or modification of the present disclosure are within the scope of the present disclosure, and the specific protection scope of the present disclosure may be clearly defined by the appended claims.

[Detailed Description of Main Elements]

| | |
|---|---|
| 10: shell | 20: pad unit |
| 23: first pad portion | 25: second pad portion |
| 27: insertion portion | 27a: slit portion |
| 30: visor | 35: visor controller |
| 40: wire | 50: control member |
| 53: base member | 55: operation member |
| 60: clamp | 100: guide member |
| 110: certain line | 113: first area |
| 115: second area | 120: display unit |
| 130: perforated line | |

INDUSTRIAL APPLICABILITY

The present disclosure provides a guide means for a helmet which may prevent a wire from being pressed or pushed by a preset member by employing a guide member for guiding the preset member (clamp for fixing wireless communication equipment) into a space between a shell and the wire, the wire being connected to a control member for controlling a movement member (visor).

The invention claimed is:

1. A guide means for a helmet, comprising:

a guide member configured to secure a space between a shell and a wire in order to guide a preset member to be inserted into the space between the shell and the wire, the wire being connected to a control member for controlling a movement member of a helmet, wherein the guide member is coupled to the wire and extends from the wire, a pad unit provided inside the shell, wherein the guide member is located between the pad unit and the shell, and wherein when the guide member is pulled, the preset member is inserted into the space between the wire and the shell.

2. The guide means for a helmet according to claim 1, wherein the guide member is coupled to the wire to surround the wire.

3. The guide means for a helmet according to claim 1, wherein the guide member is formed in a sheet shape.

4. The guide means for a helmet according to claim 3, wherein an adhesive component is formed on one surface of the guide member.

5. The guide means for a helmet according to claim 4, wherein the guide member is folded along a certain line so that the one surface of the guide member is divided into a first area and a second area based on the certain line, and the first area and the second area are adhered to each other by the adhesive component.

6. The guide means for a helmet according to claim 3, wherein a display unit for guiding insertion of the preset member is displayed at one end of the guide member.

7. The guide means for a helmet according to claim 1, wherein the movement member is a visor, and the control member is configured to control pivoting of the visor.

8. The guide means for a helmet according to claim 1, wherein the pad unit comprises:

a first pad portion located inside the shell; and a second pad portion located inside the first pad portion and comprising an insertion portion formed on one side, the insertion portion being inserted between the shell and the first pad portion, wherein, when one end of the wire coupled to the control member is located between the shell and the insertion portion, a slit portion or a through-portion through which the wire passes is formed in the insertion portion, and the wire passes through the slit portion or the through-portion, and then is located between the insertion portion and the first pad portion.

9. The guide means for a helmet according to claim 8, wherein the guide member is coupled to the wire passing through the slit portion or the through-portion and is covered by the insertion portion.

10. The guide means for a helmet according to claim 1, wherein the preset member is a clamp for fixing wireless communication equipment to the helmet.

* * * * *